US005299964A

United States Patent [19]

Hopkins

[11] Patent Number: 5,299,964

[45] Date of Patent: Apr. 5, 1994

[54] AMUSEMENT RAFT RIDE

[75] Inventor: Ogden D. Hopkins, Contoocook, N.H.

[73] Assignee: O. D. Hopkins Associates, Inc., Contoocook, N.H.

[21] Appl. No.: 702,476

[22] Filed: May 20, 1991

[51] Int. Cl.[5] ..... B63B 3/00

[52] U.S. Cl. ..... 114/346; 114/249

[58] Field of Search ..... 104/70; 441/35, 40, 441/129-132, 65-67, 345, 346; 114/249, 363, 352, ; 472/13, 117, 128, 129

[56] References Cited

U.S. PATENT DOCUMENTS

| | | | |
|---|---|---|---|
| 2,453,155 | 11/1948 | Nelson et al. | 104/70 |
| 3,221,696 | 12/1965 | Gardner | 114/43.5 |
| 3,404,635 | 10/1968 | Bacon et al. | 104/70 |
| 3,821,825 | 7/1974 | Bailey | 114/363 |
| 3,853,067 | 12/1974 | Bacon | 104/70 |
| 4,198,043 | 4/1980 | Timbes et al. | 104/70 |
| 4,299,171 | 11/1981 | Larson | 104/70 |
| 4,315,475 | 2/1982 | Echols | 441/130 |
| 4,337,704 | 7/1982 | Becker et al. | 104/70 |
| 4,392,434 | 7/1983 | Durwald et al. | 104/70 |
| 4,516,943 | 5/1985 | Spieldiener et al. | 441/35 |
| 4,805,897 | 2/1989 | Dubeta | 272/56.5 R |
| 4,836,521 | 6/1989 | Barber | 272/32 |
| 4,938,722 | 7/1990 | Rizley | 441/131 |
| 4,968,278 | 11/1990 | Lemke et al. | 441/129 |
| 4,984,783 | 1/1991 | Fujimaki | 272/56.5 R |
| 5,020,465 | 6/1991 | Langford | 441/129 |
| 5,101,753 | 4/1992 | Hull et al. | 114/363 |

*Primary Examiner*—Edwin L. Swinehart

*Attorney, Agent, or Firm*—Pollock, Vande Sande & Priddy

[57] ABSTRACT

A raft for an amusement ride is provided. The raft has at least one passenger support having accommodations sufficient to accommodate at least one passenger thereon. At least one link is provided on the raft, and is compatible with a link on another raft to allow the interconnection of a plurality of rafts to form the amusement ride. The passenger support is connected to a buoyant portion of the raft through a rotary connector to allow rotation of the passenger support relative to the buoyant portion of the raft.

48 Claims, 16 Drawing Sheets

AMUSEMENT RAFT RIDE

TECHNICAL FIELD

The present invention relates to an amusement ride raft, and more particularly to a raft for carrying passengers on an amusement ride which has water flowing along a water-course.

BACKGROUND OF THE INVENTION

Amusement rides of the prior art include those wherein a boat or raft is moved along a watercourse by a flow of water Such boats or rafts may be free floating such as the raft of U.S. Pat. No. 4,516,943, or sliding such as the boat or toboggan of U.S. Pat. No. 4,984,783.

In amusement rides with such prior art water rafts the entire raft typically rotates when a peripheral member thereof contacts a wall of the channel defining the watercourse or an obstruction or guide member in or adjacent to the watercourse. Such rotation tends to avert excessive rubbing action between the interconnected rafts and wall portions, obstructions and other objects engaged by the rafts as they travel along the watercourse It appears that there is a continuing demand for improved water rides that provide an interesting experience for riders and/or more controlled action of the rafts and/or more flexible or increased seating capacity. The present invention is aimed at fulfilling these and other needs.

SUMMARY OF THE INVENTION

The invention has several aspects. According to a first aspect, the invention provides an amusement ride for carrying at least one passenger along a channel containing flowing water. The ride comprises a raft having at least one passenger support, at least one buoyant member and at least one connection between the buoyant member and at least one other connected portion of the raft, the connection comprising at least one rotary connector which provides rotation of the buoyant member relative to the connected portion. This combination is useful in linked and unlinked rafts.

One advantage of the invention is that it permits and involves the linking of rafts together. Thus, according to a second aspect, the invention is specifically directed to linked rafts and provides an amusement ride for carrying plural passengers along a flow path in a channel containing flowing water. In this aspect the ride comprises plural rafts each having at least one passenger support and at least one buoyant member. The rafts further comprise at least one connection, in each of at least two such rafts, between the respective buoyant member and at least one other connected portion of each of such rafts. The connection comprises at least one rotary connector which provides rotation of the respective buoyant member relative to the respective other connected portion At least one link extends between and connects the at least two rafts for retaining them generally adjacent one another, and provides the linked rafts freedom of motion relative to one another, at the link or links, in at least one direction.

The foregoing aspects of the invention, as well as the third aspect of the invention described below, may be embodied in a variety of ways, various preferred and exemplary but not limiting embodiments being described herein, it being understood that other embodiments can be evolved by those skilled in the art without departing from the spirit of the invention. The invention contemplates combining each individual one of the following described features, and each possible union of the following individual features, with the first, second or third aspects of the invention described above and below, and such combinations are considered inventions in their own right.

As indicated above, the foregoing first and second aspects of the invention may be embodied in a variety of ways. By way of example, in the amusement rides as above described, the buoyant member may be connected indirectly to the other connected portion. The other connected portion may be the passenger support, and the passenger support and the buoyant member may be connected to one another through the rotary connector to provide rotation of the buoyant member relative to the passenger support. Also, the raft may include a frame in addition to the passenger support, the other connected portion being the frame, and the frame and buoyant member may be connected to one another through the rotary connector to provide rotation of the buoyant member relative to the frame.

Each of the at least two rafts may include a frame in addition to the passenger support, the other connected portion may be the frame, and the frame and buoyant member may be connected to one another through the rotary connector to provide rotation of the buoyant member relative to the frame. The passenger support may be fixedly secured to the frame.

Embodiments of the first or second aspects may be provided with particularly preferred arrangements of the respective passenger supports, which may be or include platforms or seats or restraint systems or the like, or any combination thereof. Thus, the raft or each of the at least two rafts may have a passenger support, such as a platform, with an outline in plan view which is non-circular. For example, the respective passenger support of the raft or of each of the at least two rafts may have an outline in plan view which is elongated generally in the direction of the flow path. Either the first or second aspect may be embodied with the respective passenger support of the raft or of each of the at least two rafts having seats disposed thereon in one or more arrays that, as viewed in plan view, may be non-circular. The respective passenger support of the raft or of each of the at least two rafts may have seats disposed thereon in one or more arrays that, as viewed in plan view, extend generally in the direction of the flow path.

Any apparatus as above described may have a rotary connector which provides relative rotation of the buoyant member and passenger support about a generally upright axis.

In apparatus of this type the respective passenger support of the raft or of each of the at least two rafts may have seats with backs arranged substantially on one or more lines that, as viewed in plan view, may be skewed substantially relative to radii passing through the lines midway between the sides of the seat backs and through the generally upright axis.

Several preferred embodiments relate to the linked rafts of the second aspect. Thus, in apparatus as above described the at least two rafts may be joined in series relationship with one another along the flow path. The link may be a resilient member. The link may be a universal connector. Preferably, the link includes a member, extending between adjacent rafts joined by the link, which is resistant to longitudinal compression and extension exerted thereon by movement of the rafts toward and away from one another. Linked rafts may have horizontal axes which pass through the link and across the centers of their respective rotary connectors, and the linked rafts may have freedom of motion relative to one another through the link or links in at least one direction which is not parallel to and does not coincide with the axes. Such freedom of motion may include motion about at least one axis selected from among pitch, yaw, roll and combinations thereof. Alternatively, such freedom of motion may include motion about the yaw axis, motion about at least one other axis selected from among pitch and roll, and combinations of any of the foregoing.

The invention contemplates various relationships between the linked or unlinked rafts and the water and channel. In apparatus as above described, the raft or each of the at least two rafts may be fully or at least partly afloat in the water in the channel. However, the term raft is not limited to conveyances or vehicles that are either fully or constantly afloat. The raft or each of the at least two rafts is preferably at least substantially afloat in water along at least a substantial part of the length of the channel, and the flow of water preferably causes the raft or rafts to move through at least a substantial part of the length of the channel.

Preferably, the channel includes guide members distributed along the flow path in position to contact portions of the buoyant member or members of the raft or rafts as they move along the flow path. Thus, the channel may for example include guide members distributed along the flow path in position to contact portions of the buoyant member or members but not the passenger support or supports as the raft or rafts move along the flow path. Also, the channel may include guide members distributed along the flow path in position to contact the buoyant member of the raft or of each of the at least two rafts and to rotate the buoyant member relative to the passenger support to which it is connected.

The channel may include guide members distributed along the flow path and positioned to cause undulating motion of the raft or rafts, including pitch or yaw or roll or any combination thereof Guide members may comprise or be portions of one or more walls of the channel, or non-rectilinear portions of one or more walls of the channel, or portions of side and/or bottom walls of the channel which extend in different directions than other adjacent portions of the walls.

According to a third aspect, the invention provides an amusement ride for carrying at least one passenger along a channel containing flowing water. The ride comprises at least one raft means adapted to be moved along the channel by the flowing water. The raft means comprises frame means; passenger support means providing for the occupancy of the raft by at least one passenger; securing means for securing the passenger support means to the frame means; buoyant means for causing flotation of the raft means; and rotary connector means. The latter mounts at least one part of the buoyant means for rotation relative to the frame means, while the buoyant means part comprises engaging means for engaging a wall of the channel to cause the buoyant means part to rotate relative to the frame means.

As indicated above, the third aspect of the invention described above may also be embodied in a variety of ways. Thus, by way of example, in the third aspect of the amusement ride the frame means, passenger support means and securing means may be arranged in an assembly in which they are in fixed relationship with one another, and the rotary connector means connects the buoyant means with the frame for rotation of the buoyant means relative to the assembly. Alternatively, the frame means, passenger support means and securing means may be arranged in an assembly in which the securing means provides rotation of the passenger support means relative to the frame means. An amusement ride as above described may further comprise means operable by the at least one passenger for causing the passenger support means to rotate relative to the frame means. Moreover, the rotary connector means may comprise means for providing rotation of the buoyant means relative to the passenger support means.

Certain particularly preferred embodiments involve specified forms and relationships of the buoyant means. For example, the buoyant means may comprise annular wall means defining at least one peripheral air chamber, and the rotary connector means comprises means for providing rotation of the annular wall means relative to the frame means. The engaging means may be positioned along an outer periphery of the buoyant means, at least a portion of the outer periphery being formed by a raft wall of the annular wall means, and the engaging means comprising an elastomeric material at an outer surface of the raft wall for frictionally engaging the channel wall.

Because the invention permits the linking of rafts together, the amusement ride may for example comprise a first one of the raft means according to its above-described first aspect, a second one of the raft means, and link means for connecting together the frame means of the first raft means and the frame means of the second raft means so that the first and second raft means travel together along the channel, the link means providing for movement of the first and second raft means relative to each other in at least one of yaw, pitch and roll.

The linked rafts also have various preferred and exemplary but not limiting embodiments. For example, the amusement ride of linked rafts may further comprise a channel having upstanding sidewalls in sufficiently closely spaced relation to prevent one of the raft means from passing the other of the raft means while the two raft means are travelling together along the channel.

The link means may take various forms. For example, it may comprise pivot means for providing pivotal movements of the first and second raft means relative to each other in yaw, pitch and roll. It may comprise pivot limit means for limiting the range of at least one of the pivotal movements. Also, the pivot means may comprise at least one universal joint. In another embodiment the link means may comprise elongated bar means, the elongated bar means may comprise a first member, a second member mounted for extensible movement relative to the first member, and shock absorbing means for dampening the extensible movement of the second member relative to the first member.

Linked and unlinked amusement rides as above described may be embodied with or without special forms or relationships of the frame means, passenger supports and other parts described below. For example, the frame means may have a substantially circular periphery, and the passenger support means may comprise a plurality of seats for occupancy by a corresponding number of passengers, the seats facing radially inward. Also, the frame means may have a substantially rectangular periphery, and the passenger support means may comprise a plurality of seats for occupancy by a corresponding number of passengers, the seats facing in substantially the same direction and being arranged in at least one row. Optionally, the plurality of seats may be arranged in a plurality of rows.

In an amusement ride as above described the buoyant means may comprise a plurality of rotatable parts, wherein the rotary connector means includes means for mounting each of the rotatable parts for rotation relative to the frame means, and wherein each of the rotatable parts may comprise engaging means for engaging the channel wall to cause the corresponding rotatable part to rotate relative to the frame means. The rotatably mounted part of the buoyant means may have a substantially continuous outer periphery defining a closed curve. This closed curve of the outer periphery may lie substantially in a common plane and be circular in shape.

Different embodiments of the invention may provide one or more of the advantages described below. The rotation aspect of the raft makes it practical for two or more rafts to be connected together as they traverse the watercourse by averting excessive rubbing action between the interconnected rafts and the wall portions, obstructions and other objects which are engaged by the rafts as they travel along a watercourse.

The linking aspect of the invention counters the tendency of a following raft to ride over the edge of a preceding raft when the rafts are traversing rough water simulating river rapids Having connected rafts pivoted relative to one another around pitch and roll axes contributes to better control of the rafts and potentially increases safety, while keeping the ride exciting for the passengers. The invention provides a connection between water borne rafts that has the desired freedom of movement and is sufficiently sturdy and safe to be used for connecting together the water borne rafts of an amusement ride.

The invention allows a greater dispatch interval between groups of rafts, thereby allowing a longer period of time for passengers to load and unload. The combined capacity of the rafts within a group or chain also allows a greater hourly capacity than could otherwise be obtained with single rafts. Hourly capacities in excess of 2400 passengers per hour are readily achievable.

The invention facilitates operations involving a greater distance between groups of rafts than is normally provided between single rafts. This affords opportunities to design amusement rides with themeing, such as animation or shows, in which more time is provided for completion of the show or for passenger viewing, while still maintaining high capacities, such as those previously mentioned.

A group of small linked rafts according to the invention may be embodied in such a way as to provide much greater freedom of motion in reaction to water flow than a large raft of the same passenger capacity. The smaller rafts, due to their smaller mass as compared to that of the large raft, will react more vigorously to the undulating water, thereby providing increased passenger enjoyment and appeal.

BRIEF DESCRIPTION OF THE DRAWINGS

The construction, operation and use of the invention may be further understood from the detailed description thereof as given below taken in conjunction with the accompanying drawings, in which.

DETAILED DESCRIPTION OF BEST MODE AND OTHER EMBODIMENTS

Figure 1:
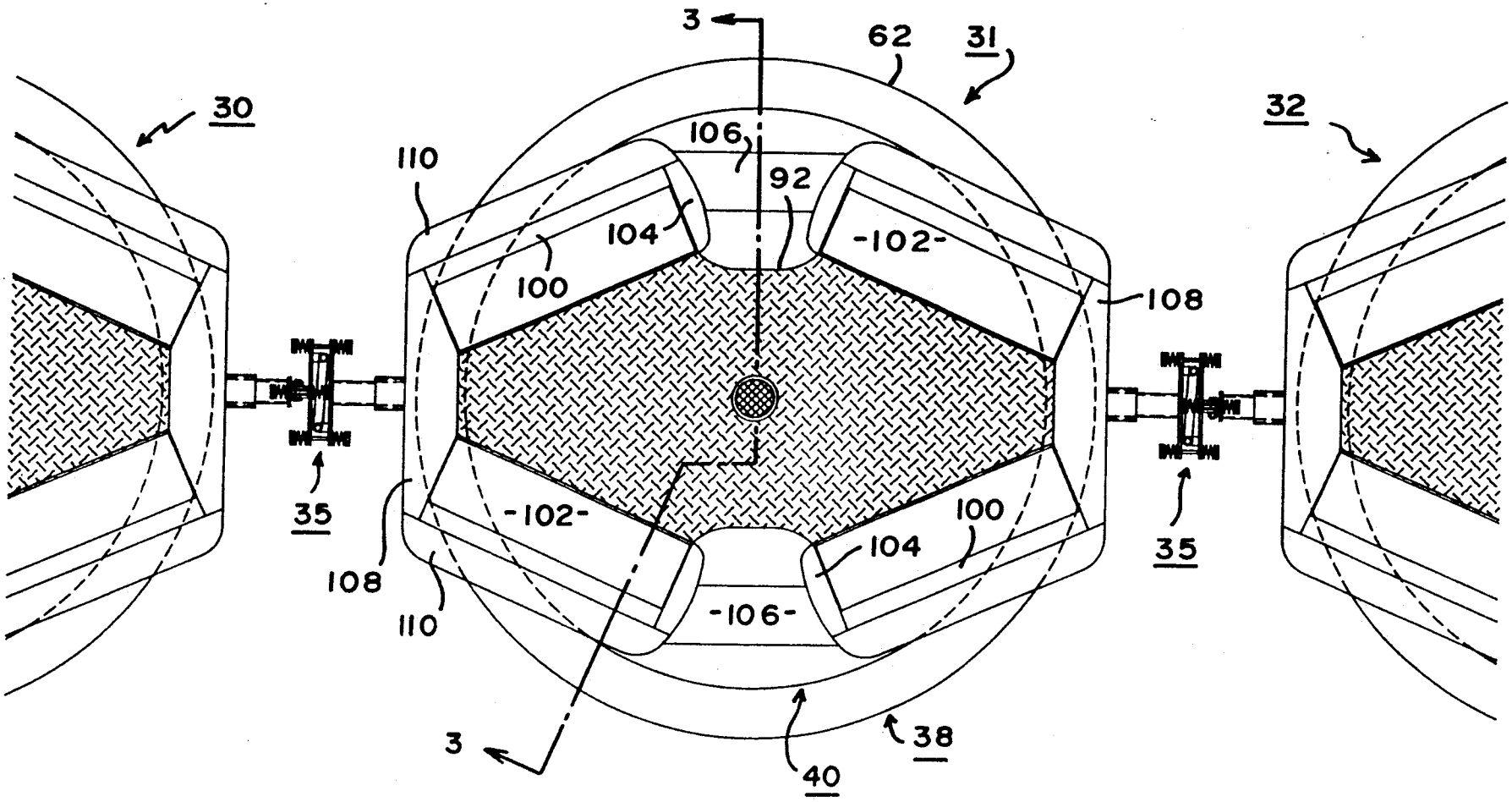
FIG. 1 is a plan view of one complete raft of the invention, and also partially showing a train or group of linked rafts.

According to one preferred embodiment the passenger support may include a passenger platform connected to the buoyant member through the rotary connector to afford rotation of the buoyant member relative to the passenger support. As an alternative, the raft may include a frame in addition to the platform of the passenger support, and the frame and the buoyant member may be connected to one another through the rotary connector to afford rotation of the buoyant member relative to the frame. In this alternative, the passenger platform may be fixed either to the frame or to the buoyant member. Where the passenger platform is fixed to the buoyant member, the rotary connector affords rotation of both the passenger platform and the buoyant member relative to the frame. As a further alternative, the passenger platform may be rotatably connected to the frame by a second rotary connector so that the passenger support and buoyant member rotate independently of each other relative to the frame. In this embodiment the second rotary connector may be referred to as a securing means, but the term securing means may, in the case of other embodiments, be a non-rotary connector, including means which fixedly secure the platform of the passenger support to the frame. Where the passenger platform rotates independent of the buoyant member, a handhold or other mechanism operable by at least one passenger may be provided for causing the passenger platform to rotate relative to the frame, the buoyant member or both of them. The flotation structure of a single passenger platform also may comprise two or more buoyant members mounted for rotation relative to the remainder of the raft by a corresponding rotary connector. Rotation of the buoyant member and rotation of the platform (where provided) is preferably about a generally upright axis.

Various components of the ride may be fabricated of polymers or polymeric materials, including any of a wide variety of natural and synthetic rubbery and resinous polymeric materials, such as natural rubber, acrylic resin (e.g. lucite), styrene-butadiene (SBR synthetic rubber), styrene-acrylonitrile (SAN resin), polyester and polyether resins, urethanes and others Some of these components, especially those supplying floatation or otherwise filling space may be fabricated of porous polymers, which includes polymeric material formed in such a way as to contain pores and/or cells, including for example open or closed cell foams, such as those of polyester- or polyether-urethane and others, which may or may not include fibrous or particulate reinforcing materials, fillers or the like.

The rotatably mounted buoyant means preferably comprises an annular wall which defines at least one peripheral air chamber, which is inflatable to different air pressures. The annular wall may be made of a flexible material having a shape maintained by the air pressure in the peripheral air chamber. The rotatably connected buoyant structure, the frame and the passenger platform may comprise other buoyant members of an inflatable, solid or liquid type, sections of a closed cell, foamed solid material being preferred.

The passenger support may have a plurality of passenger seats and mounted on the passenger platform. The outline of the passenger platform in plan view may be substantially circular with the seats positioned in a substantially circular array. On the other hand, the passenger platform in plan view may be non-circular, such as a rectangle or oval elongated generally in the direction of raft movement along the watercourse. Where the outline of the passenger platform is elongated, the passenger seats are preferably positioned in non-circular arrays, such as one or more rows extending generally in the direction of raft movement, with the seats in each row facing forward, rearward, to either side or combinations thereof. Where the passenger platform is circular or non-circular and mounted for rotation relative to the buoyant member and/or frame, the passenger seats may face radially inward or outward relative to the rotary axis of the platform, or may face in a direction canted relative to the radial direction.

Although each raft may move along the watercourse independently of the others, a plurality of the rafts are preferably linked by linkage assembly between adjacent rafts so that a group of the rafts proceed one after the other or in any other suitable orientation along the flow path provided by the watercourse. The linkage assembly preferably comprises a universal connection providing for relative pivotal movement between adjacent linked rafts about one or more of the three mutually perpendicular axes of yaw, pitch and roll, including any combinations thereof. However, the range of each of these pivotal movements can be limited to prevent damage to the rafts and/or injury to the passengers. Thus, the structure of the interconnecting linkage can limit relative movement about the pitch and yaw axes, while the amount of buoyancy provided by the respective buoyant members can limit the relative movement about the roll axis. In this regard, the roll axis passes generally through the linkage and the respective centers of adjacent rafts when the rafts are aligned, the yaw axis is a generally vertical axis passing through the linkage assembly, and the pitch axis is a generally horizontally axis passing through the linkage assembly.

The linkage assembly may be of the ball joint type wherein a ball on one linkage member is held for at least limited universal rotation in a socket carried by another linkage member. Instead of a single ball joint connection, the linkage may include an elongated intermediate member having longitudinally spaced balls thereon which are retained for swiveling motion in corresponding sockets, one on each linkage member rigidly fixed to its corresponding raft. This linkage assembly provides freedom of motion of the linked rafts relative to one another that includes lateral translation of the roll axis of one raft relative to the roll axis of an adjacent raft.

More preferably, the universal connection comprises a resilient structure wherein two members are interconnected and biased by one or more springs to resist both longitudinal compression and longitudinal extension of the linkage assembly in response to movement of adjacent rafts toward and away from one another, thereby absorbing shocks and damping out jerky motion between adjacent rafts. The resilient connection between the two linkage members also provides relative movement between the rafts about pitch and yaw axes at the connection, and each member is rotatably connected to a corresponding raft to provide relative rotation of the rafts about a roll axis at the connection.

Whether the rafts are independent from each other or are linked in a group, a plurality of rafts travel along one or more watercourses of the amusement ride. Each watercourse is defined by a channel having at least one wall and providing a closed circuit flow path. The watercourse is preferably sinuous in the horizontal plane and may be relatively flat or undulating in the vertical plane. Where the watercourse is straight, curved or sinuous in the horizontal plane, sidewall portions of the channel act as guide members for contacting the buoyant members to guide the rafts along the watercourse. Since these buoyant members are free to rotate relative to the remainder of the rafts, the wear on ride parts caused by such contact is minimized, especially where two or more rafts are linked together in a group.

Bottom and/or side portions of the water channel may undulate and thereby induce wave and churning actions in the flowing water, which in turn react against the bottom and side surfaces of the rafts, causing the rafts to pitch, yaw and roll. Such pitch, yaw and roll of the rafts also may be caused by guide members distributed along the water flow path defined by the channel. Such obstructions may be separate pieces which are either free or secured to a channel wall, or non-rectilinear portions of a wall of the channel, or wall portions which extend in directions different from adjacent portions of the wall.

Figure 2:
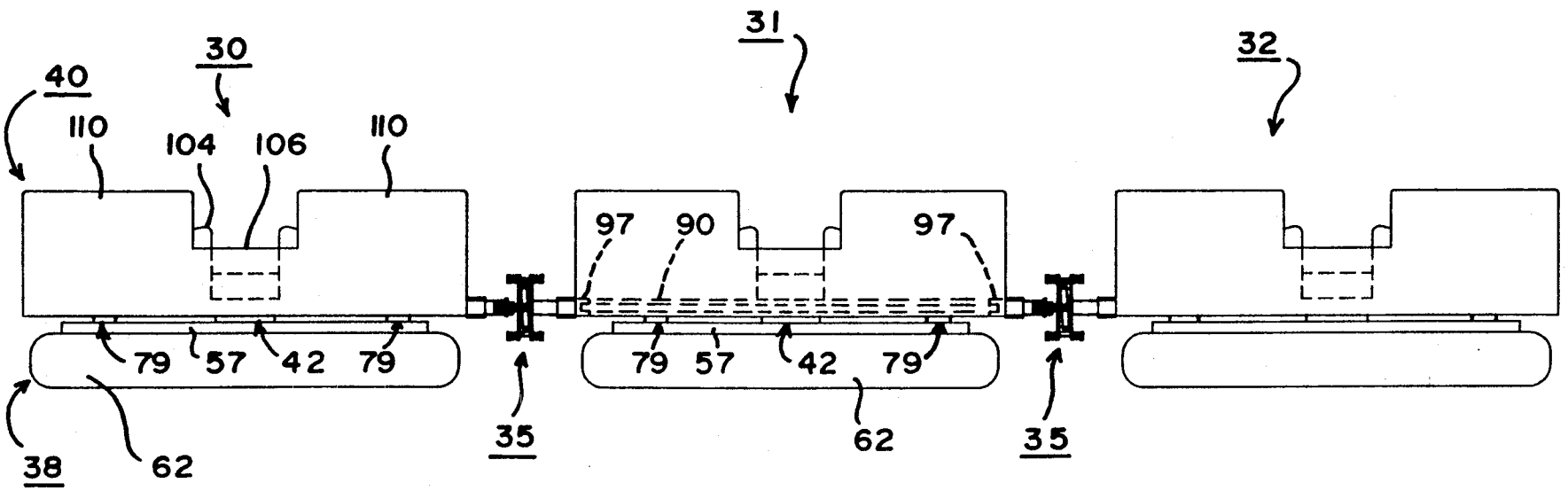
FIG. 2 is a side elevational view of the raft group of FIG. 1.
Figure 3:
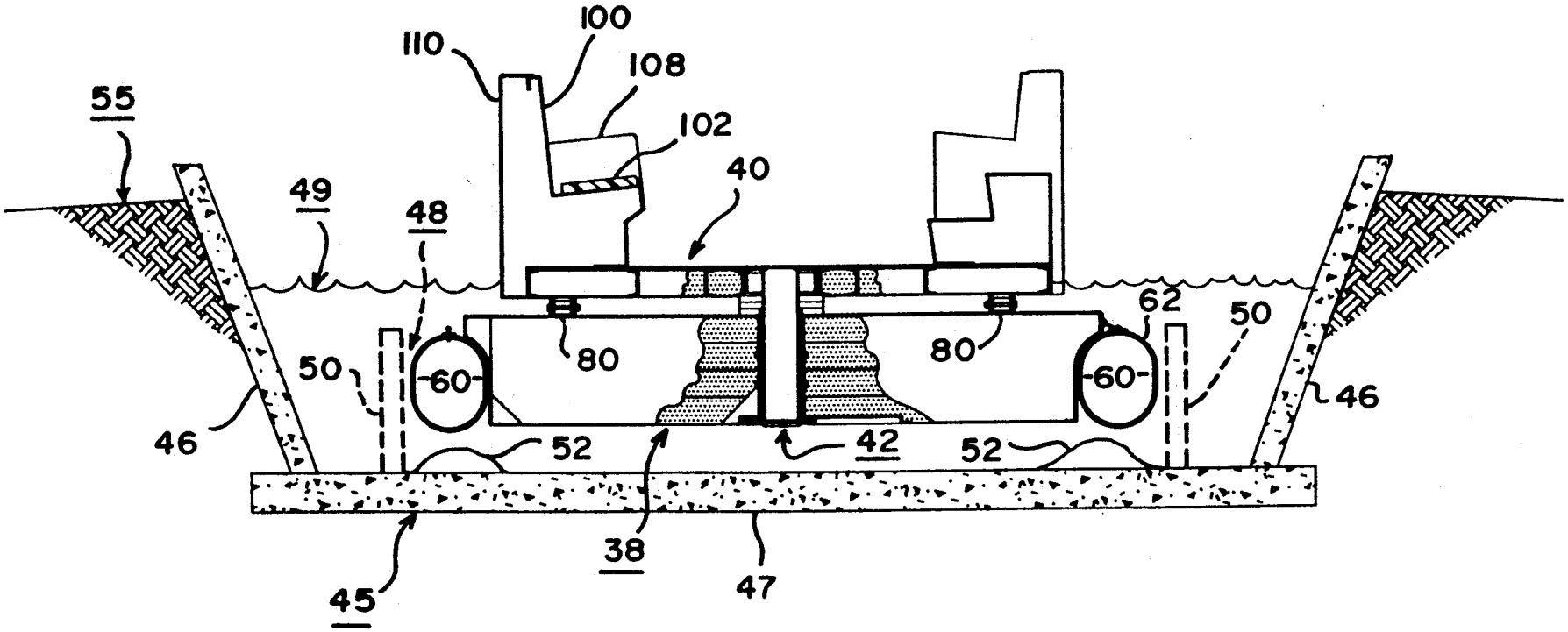
FIG. 3 is an elevational view of a raft shown in section taken along line 3—3 of FIG. 1, and also showing in section the watercourse along which the group of rafts moves.
Figure 4:
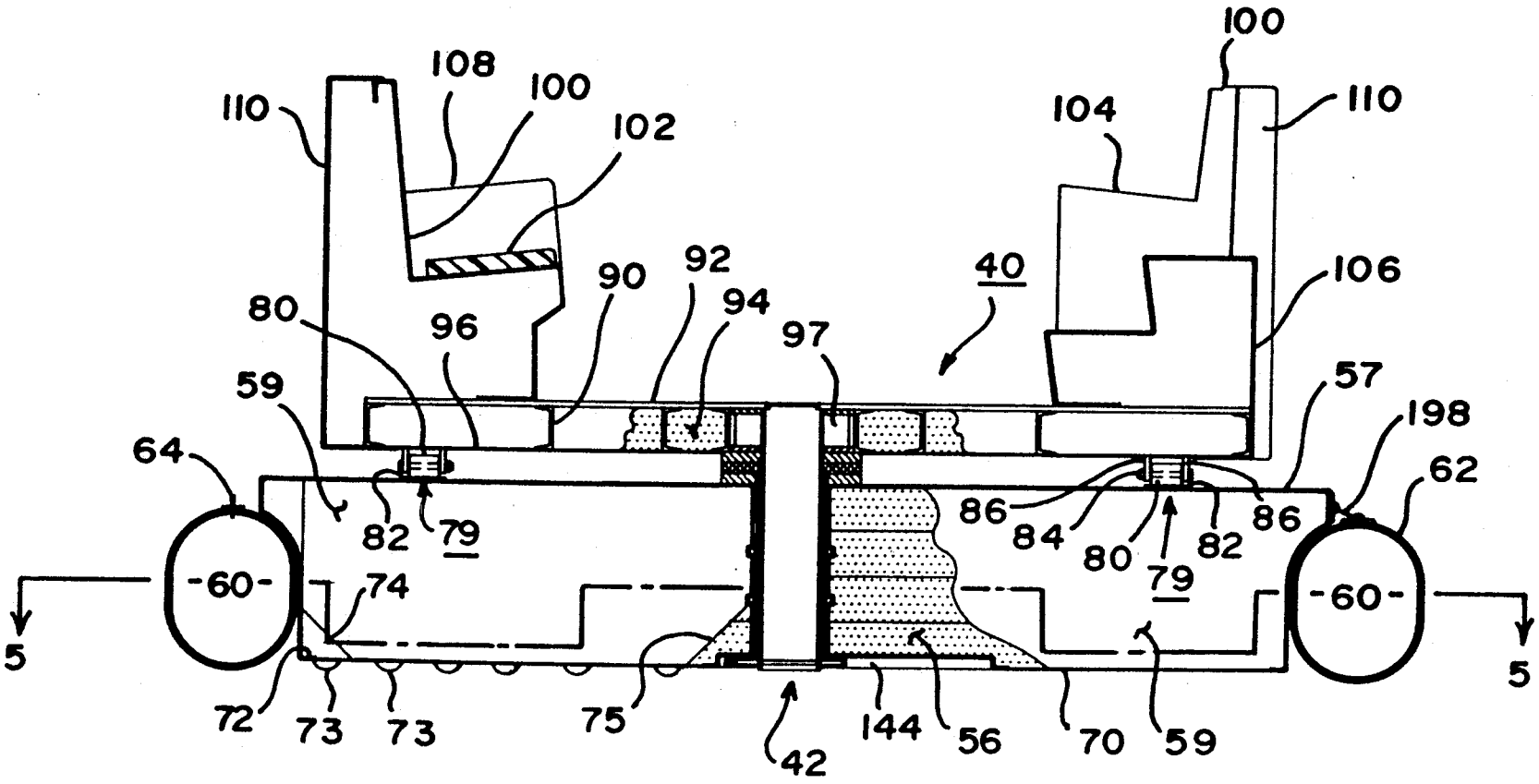
FIG. 4 is an enlarged elevational view in partial section of the raft as shown in section in FIG. 3.

In FIGS. 1 and 2, there is shown a group of rafts 30, 3 and 32 interconnected by linkage assemblies, each generally designated 35. Referring now to FIGS. 3 and 4, each raft has a flotation hull 38 and a passenger platform 40 rotatably connected together by a rotary connector 42. The hull 38 supports the raft in at least a partly floating condition in a watercourse 45 having opposing sidewalls 46, 46 and bottom wall 47. Although the walls of the watercourse shown in FIG. 3 are made of concrete, the watercourse may be made of metal, fiberglass-reinforced polymeric material or other materials and may be defined by a single wall of substantially continuous material, instead of having separately formed bottom and sidewalls.

Watercourse 45 defines the flow path for a water stream 49 which may be fed to and discharged from the watercourse by pumping stations (not shown) to create a current for moving the rafts along a channel or raft pathway defined by raft guide members. A water current for moving the rafts also may be created by tilting the watercourse longitudinally relative to the horizontal. Raft 38 also may slide along a tilted watercourse on a thin film of water covering bottom wall 47, instead of providing sufficient water for raft 38 to be free floating as shown in FIG. 3.

The sidewalls 46, 46 of the watercourse may also serve as the guide members for the rafts, or optionally the flow path of the water stream 49 as defined by watercourse 45 may be different from the channel travelled by the rafts, such as where a raft channel 48 is defined by independent raft guide members 50, 50 as illustrated in FIG. 3 by broken lines. Also optionally, staggered obstacles 52, 52 may be provided within the raft channel to cause the rafts to pitch, yaw or roll (or a combination of two or more thereof), by causing turbulence of the water which in turn contacts hull 38.

As is also evident from FIG. 3, rotation of hull 38 relative to platform 40 may be caused by frictional engagement of the peripheral surface of hull 38 with a guide member 50, a sidewall 46 (when it serves as a guide member), or an obstruction 52 within the watercourse. Such frictional engagement may be enhanced by making the peripheral surface from a material having a high coefficient of friction, such as natural or synthetic rubber.

Although watercourse 45 is shown embedded in ground 55 in FIG. 3, the watercourse may be elevated above the ground on a support structure (not shown), particularly where the watercourse is made of metal or of fiberglass-reinforced resin, which is significantly lighter in weight than concrete. Guide members 50 and obstructions 52 may be separately formed and mounted in the watercourse or may be formed by shaped portions of a watercourse wall. Such shaped wall portions may be non-rectilinear and may extend in directions different from adjacent portions of the wall(s). Furthermore, the watercourse and/or the raft channel may have undulations in the horizontal plane, the vertical plane or various combinations thereof Multiple channels for guiding different raft groups also may be provided in a single watercourse.

Figure 5:
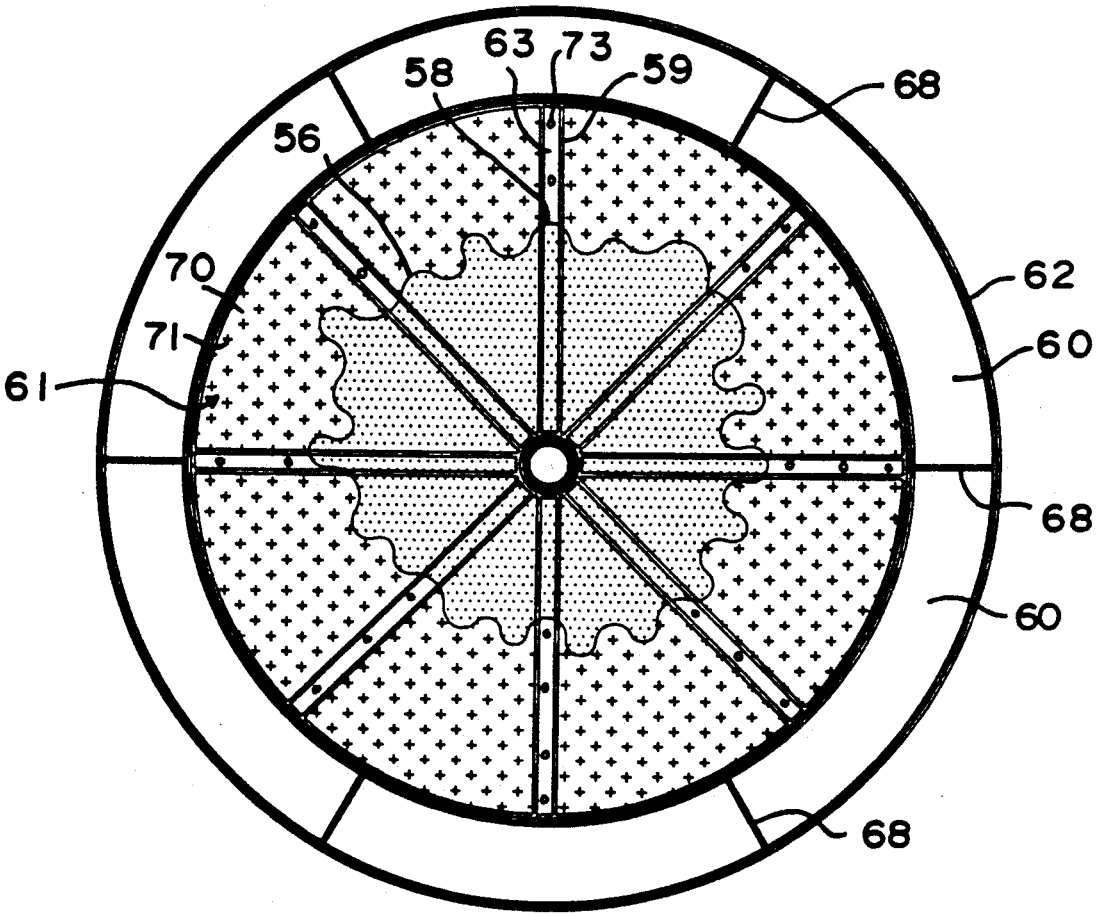
FIG. 5 is a plan view of a raft hull shown in section taken along line 5—5 of FIG. 4.

Referring now to FIGS. 4 and 5, hull 38 is buoyant and includes a plurality of stacked wedge-shaped floatation sections 56 mounted in wedge-shaped compartments 61 within a shell 57. The walls of the wedge-shaped compartments are formed by the upwardly extending legs of a plurality of U-shaped braces or ribs 59 for reinforcing the shell 57. Both shell 57 and ribs 59 are preferably made of molded fiberglass.

Floatation sections 56 are preferably made of closed cell polyethylene foam. Foam floatation sections 56 are retained in wedge-shaped compartments 61 by a perforated sheet which forms hull bottom 70. The perforations (holes) 71 in bottom 70 allow water to flow into and drain out of the interior of hull shell 57. Bottom 70 is preferably made of galvanized metal and is stiffened and mounted on the hull by a plurality of pop-rivets 73, some of which are connected to an annular flange 72 around the lower edge of shell 57 as shown in FIG. 4, and the rest of which are connected to the base 63 of U-shaped ribs 59 as shown in FIG. 5.

Surrounding the outer periphery of shell 57 is a doughnut-shaped air chamber 60 defined by a hollow float tube 62, which preferably is made of a flexible multi-layer neoprene and is inflatable through an air valve 64. Float tube 62 is connected to shell 57 by a series of D-rings 198, only one of which is shown in FIG. 4 and which are described more fully below with reference to FIG. 11. Inflatable float tube 62 preferably has a plurality of air chambers 60, each separated from adjacent chambers at either end by a flexible neoprene wall 68 as shown in FIG. 5, so that a puncture in the wall of one of the chambers 60 will not significantly reduce the buoyancy of the hull. There are preferably at least four, more preferably at least five and most preferably at least six, separate air chambers 60.

As previously indicated, hull 38 is connected to passenger platform 40 by a rotary connector 42 which is connected at the center of both the hull and the platform. Additional support for rotation of the hull relative to the platform may optionally be provided by a plurality of rollers 80 which travel along a race 82 secured to the upper surface of shell 57. Rollers 80, when used, are mounted on the underside platform 40 by a pin 84 rotatably secured at each end between a pair of depending ears 86, 86.

Passenger platform 40 also may be constructed so as to receive a plurality of flotation sections 94, and to include a plurality of longitudinal beams 90 cross-braced by a plurality of lateral beams 97, one of which is at each end of platform 40 and connected to a corresponding drawbar of linkage assembly 35. Beams 90 and 97 provide a framework on which is mounted a deck 92, and a perforated lower wall 96, the latter retaining flotation sections 94 in corresponding compartments of the platform The beams 90 and 97 of framework are preferably U-shaped channels made of aluminum, steel or other metal, which are turned on their sides as seen best in FIG. 4. Deck 92 is preferably made either of metal or fiberglass, and lower wall 96 is preferably made of perforated galvanized metal in the same manner as hull bottom 70.

Secured to platform 40 are a plurality of seats 100, with or without seat pads 102, and having an arm rest 104, the latter being located at the end of seat 100 adjacent to entrance and exit steps 106. An end panel 108 at each end of platform 40 provides an armrest at the end of seat 100 opposite to steps 106. Seats 100 and steps 106 are preferably made of fiberglass and seat pad 102 is preferably made of closed cell synthetic polymeric foam. Each seat 100 also is preferably provided with an exterior fiberglass panel 110 which, along with end panels 108, 108, may have an ornamental surface depicting a theme consistent with that of the amusement ride as a whole.

In the present embodiment, the above-mentioned passenger platform 40, the framework composed of beams 90 and 97, the deck 92, the perforated lower wall 96, the flotation sections 94, the seats 100 and whatever means may be employed to secure them together collectively constitute elements of a raft in which frame means, passenger support means and securing means are arranged in an assembly in which they are in fixed relationship with one another. As indicated previously, a rotary connector means may connect a buoyant means of the raft with the frame of such an assembly for rotation of the buoyant means relative to the assembly The details of a preferred embodiment for the rotary. connector 42, which rotatably connects hull 38 to platform 40, will now be described with reference to FIG. 6. Extending from platform 40 is a central support shaft 112, which is preferably a hollow tube to allow water to drain from deck 92 through a perforated drain plate 114. Support shaft 112 is securely fixed to platform 40 by an annular upper mounting plate 116 and an annular lower mounting plate 118, the inner edges of which are welded to support shaft 112 and the outer edges of which are welded to two longitudinal beams 90 and to two lateral beams 97, each of which has a centrally located portion in abutment with plates 116 and 118. Welded to the lower edges of central beams 90 and 97, along with an inner annular edge of perforated lower wall 96 of the platform, is an upper thrust plate 124 for engaging the upper side of a free floating thrust washer 126. The lower side of thrust washer 126 is engaged by a lower thrust plate 128, which is fixed to hull 38 by means of a support sleeve 130 having a plurality of laterally projecting retaining disks 132, 132, each embedded in the fiberglass of hull shell 57 which is molded around the projecting edges of these disks Relative rotation between support shaft 112 and support sleeve 130 is provided by an upper bushing 134 and a lower bushing 136. Support sleeve 130 and the hull structure carried thereby are retained for rotation on support shaft 112 by an annular locking collar 138 which is held in position by a retaining bolt 140 passing through aligned apertures in collar 138 and in the lower end of support shaft 112. Bolt 140 has a head at one end and threads at the other end engaged by a retaining nut 142. Collar 138 and its associated retaining bolt 140 and nut 142 are located in a recess 144 formed in hull bottom 70 to provide sufficient lateral clearance for insertion and removal of bolt 140 from collar 138.

The linkage assembly 35 for interconnecting rafts 30, 31 and 32 will now be described with reference to FIGS. 7–10. In this description, like parts have like numbers so that the description of duplicate structures on duplicate rafts, will not be repeated. A mounting sleeve 150 is rigidly secured to a cross beam 97 at one end of raft 31 and a first drawbar 154 is rotatably mounted in sleeve 150 as shown in FIG. 8. Although the shaft of drawbar 154 may be solid and have other cross-sectional shapes, it is preferably made from a hollow metal tube, as is mounting sleeve 150. A proximate end portion 158 of drawbar 154 is rotatably secured within sleeve 150 by locking collar 160 which is retained on proximate end portion 158 by a retaining bolt 162 having a retaining nut 163 on its threaded end. Locking collar 160 bears against a free floating thrust washer 166 which fits around the proximate end of mounting sleeve 150. A journal for relative rotation between drawbar 154 and mounting sleeve 150 is provided by an outer bushing 168, and an inner bushing 169.

Figure 7:
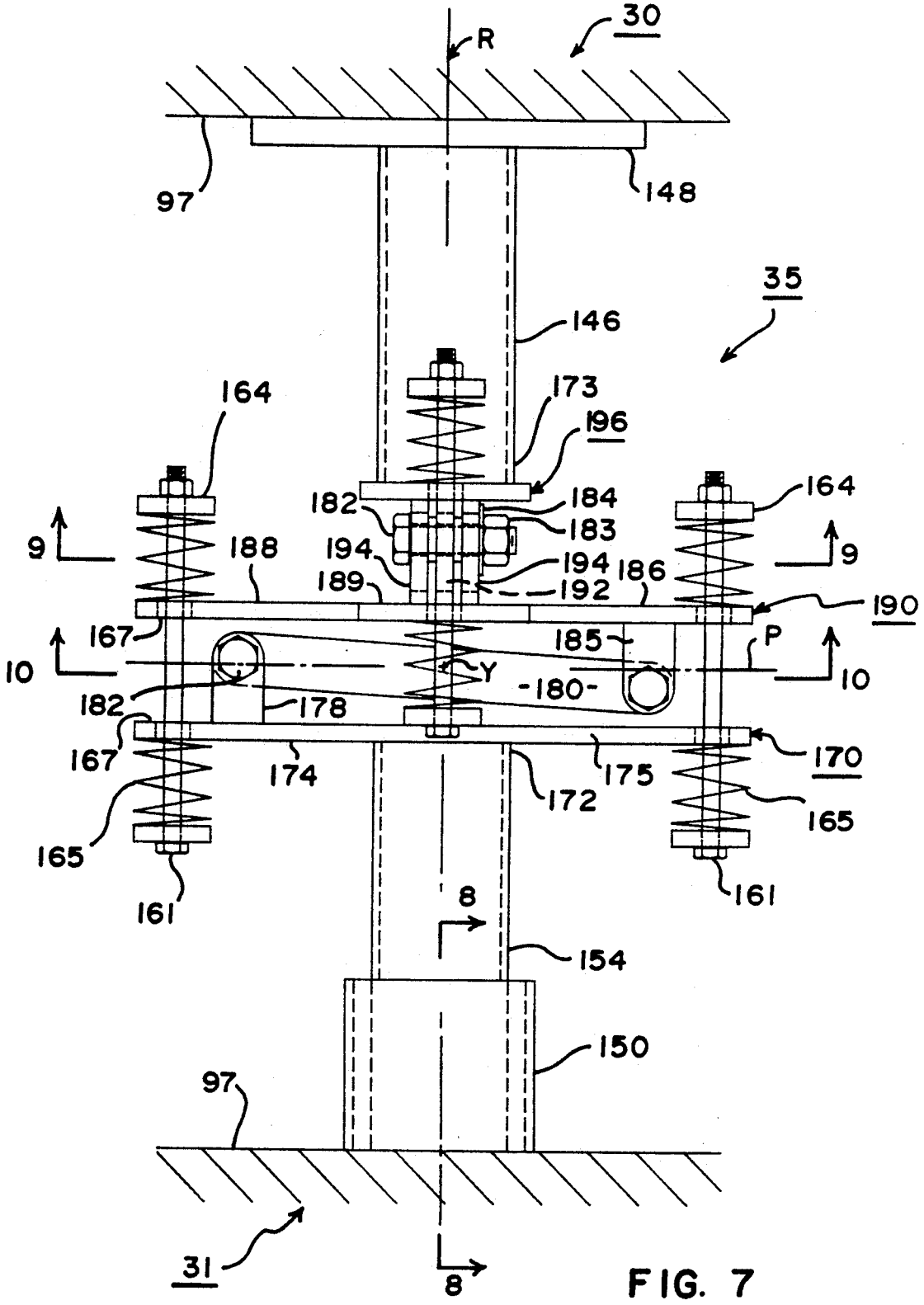
FIG. 7 is a plan view of the linkage assembly interconnecting two adjacent rafts of the raft group of FIGS. 1 and 2.
Figure 9:
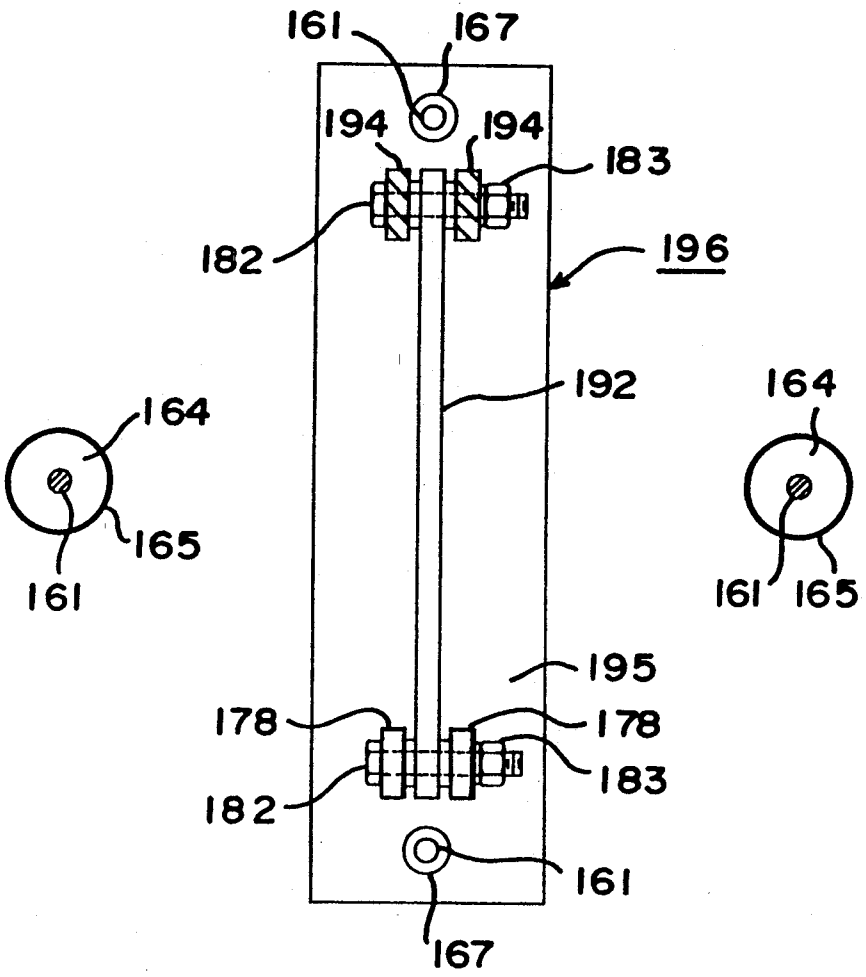
FIG. 9 is an elevational view of the linkage assembly shown in section taken along line 9—9 of FIG. 7.
Figure 8:
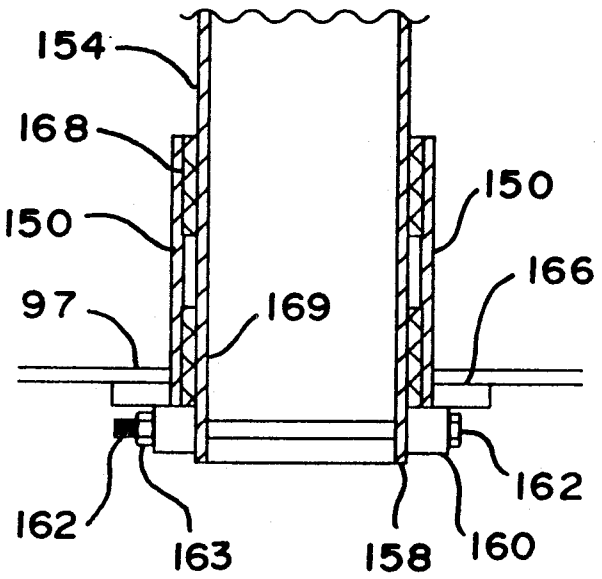
FIG. 8 is a fragmentary view of the linkage assembly shown in section taken along line 8—8 of FIG. 7.
Figure 10:
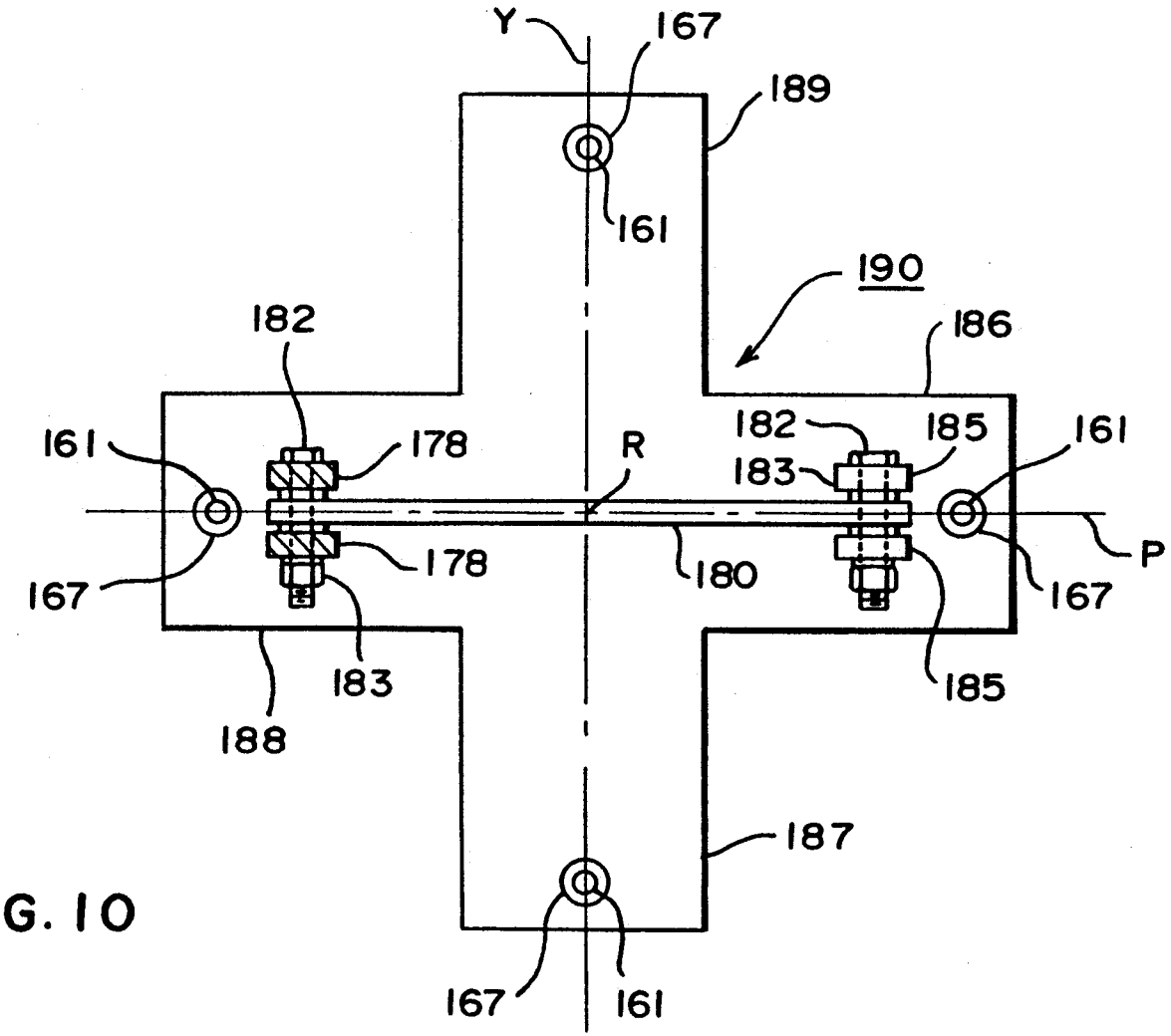
FIG. 10 is an elevational view of the linkage assembly shown in section taken along line 10—10 of FIG. 7.

As may be seen best in FIGS. 7, 9 and 10, a rectangular base plate 170 is welded to distal end portion 172 of first drawbar 154. Base plate 170 has two laterally projecting legs 174 and 175, and welded to leg 174 is a first pair of ears 178, 178, to which one end of a pivot lever 180 is attached by means of a bolt 182, nut 183 and lock washer 184. The other end of pivot lever 180 is similarly bolted to a second pair of ears 185, 185 on an opposing arm 186 of a central plate 190, which has four arms 186, 187, 188 and 189, respectively. The arm 189 of central plate 190 is pivotally attached to one end of a second pivot lever 192 by being bolted to a third pair of ears 194, 194 as shown best in FIG. 9.

The other end of pivot lever 192 is attached to a laterally projecting leg 195 of a rectangular base plate 196 in the same manner that first pivot lever 180 is attached to leg 174 of base plate 170. Base plate 196 is welded to distal end portion 173 of a second drawbar 146 which preferably is fixed to cross beam 97 at one end of raft 30, such as by a welded plate 148. In principle, as an alternative means of connection, drawbar 146 could be rotatably mounted in a second sleeve 150 (not shown) secured to cross beam 97 of raft 30 in place of plate 148. Thus, the pivot lever connections between second base plate 196 and central plate 190 are the same as those between first base plate 170 and central plate 190, except that the longitudinal axes of base plate 170 and base plate 196 are substantially perpendicular to each other. On the other hand, the longitudinal axes of base plates 170 and 196 are both perpendicular to the longitudinal axes of toe shafts of drawbars 146 and 154. The longitudinal axis of drawbar 154, which is free to rotate in sleeve 150, defines a roll axis "R" about which rafts 30 and 31 may rotate relative to each other.

The base plates 174 and 196 also are interconnected to the central plate 190 by a plurality of pins 161 and corresponding nuts and washers 164 for biasing a plurality of springs 165 against the respective plates 170, 190 and 196 as shown in FIG. 7. Each pin passes through an aperture 167 in a corresponding plate and the aperture has a larger diameter than the pin to allow lateral motion of the pin within the aperture as the rafts move relative to each other about yaw and pitch axes and combinations thereof.

The levers and biased pins of linkage assemblies 35 allow relative motions between adjacent rafts about a yaw axis Y and a pitch axis P, and combinations thereof (such as axes between axes Y and P in an imaginary plane perpendicular to roll axis R). Linkage assembly 35 is able to provide pitch and yaw angles between the adjacent rafts of at least about 5°, more preferably at least about 10°, still more preferably at least about 20° and most preferably about 30° or more. The pivot levers 180 and 192 also allow the opposing drawbars 146 and 154 to move toward and away from each other along roll axis R, and the resilience of the springs 165 absorbs the shocks of such compression and extension motions between adjacent rafts and dampens these motions. During these motions the levers 180 and 192 pivot about the bolts 182 securing their respective ends to the plates 170, 190 and 196.

Figure 11:
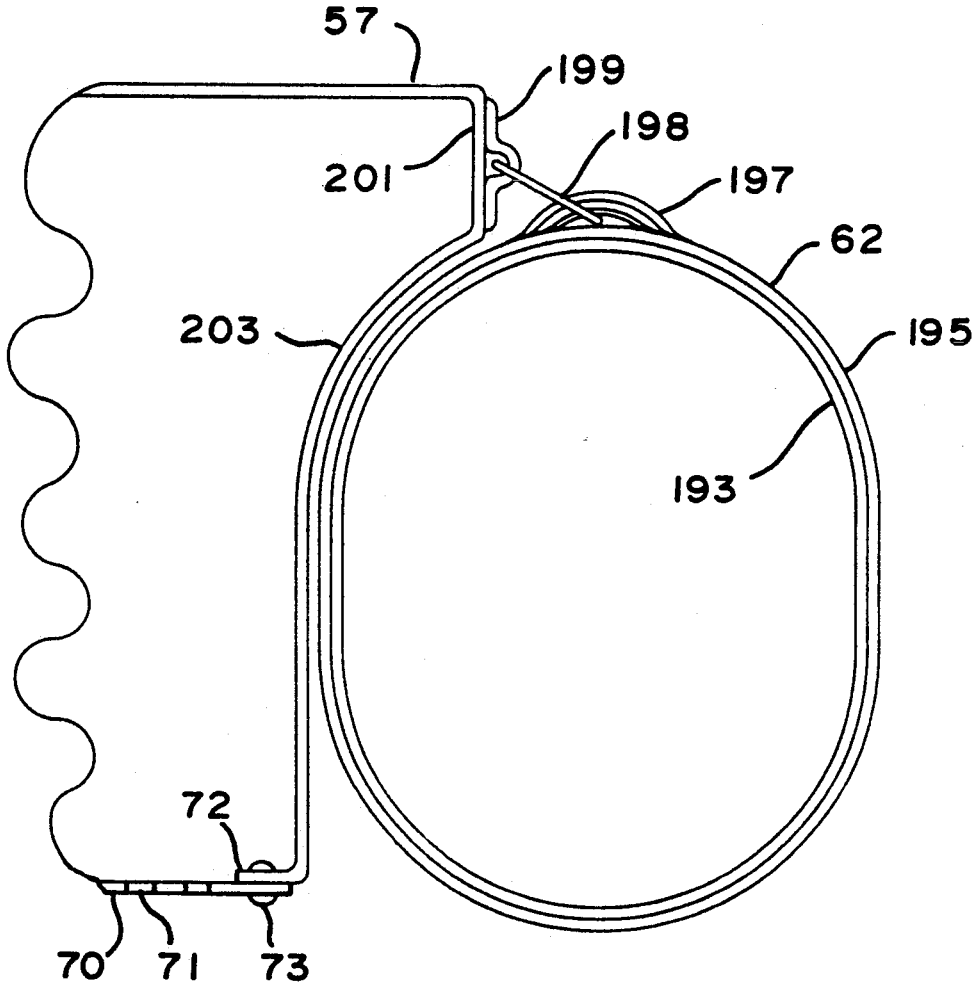
FIG. 11 is an enlarged fragmentary section taken transversely through a peripheral side portion of the raft hull shown in FIGS. 1-5.

One way in which flotation tube 9 may be secured to shell 57 of hull 38 is illustrated in FIG. 11. Tube 62 preferably comprises multiple layers of neoprene reinforced with belts of fabric or metal similar to the construction of an automobile tire Between an inner neoprene layer 193 and an outer neoprene layer 195 are laminated in the ends of a neoprene strap 197 through which is looped a metal D-ring 198. D-ring 198 also passes through an eye 199 bolted to a vertically extending sidewall portion 201 of shell 57. A lower sidewall portion 203 of shell 57 follows the contour of an opposing wall portion of tube 62 as shown in FIG. 11. This figure also shows more clearly the pop rivet connection 73 between the perforated bottom wall 70 and the lower annular lip 72 of shell 67.

Figure 6:
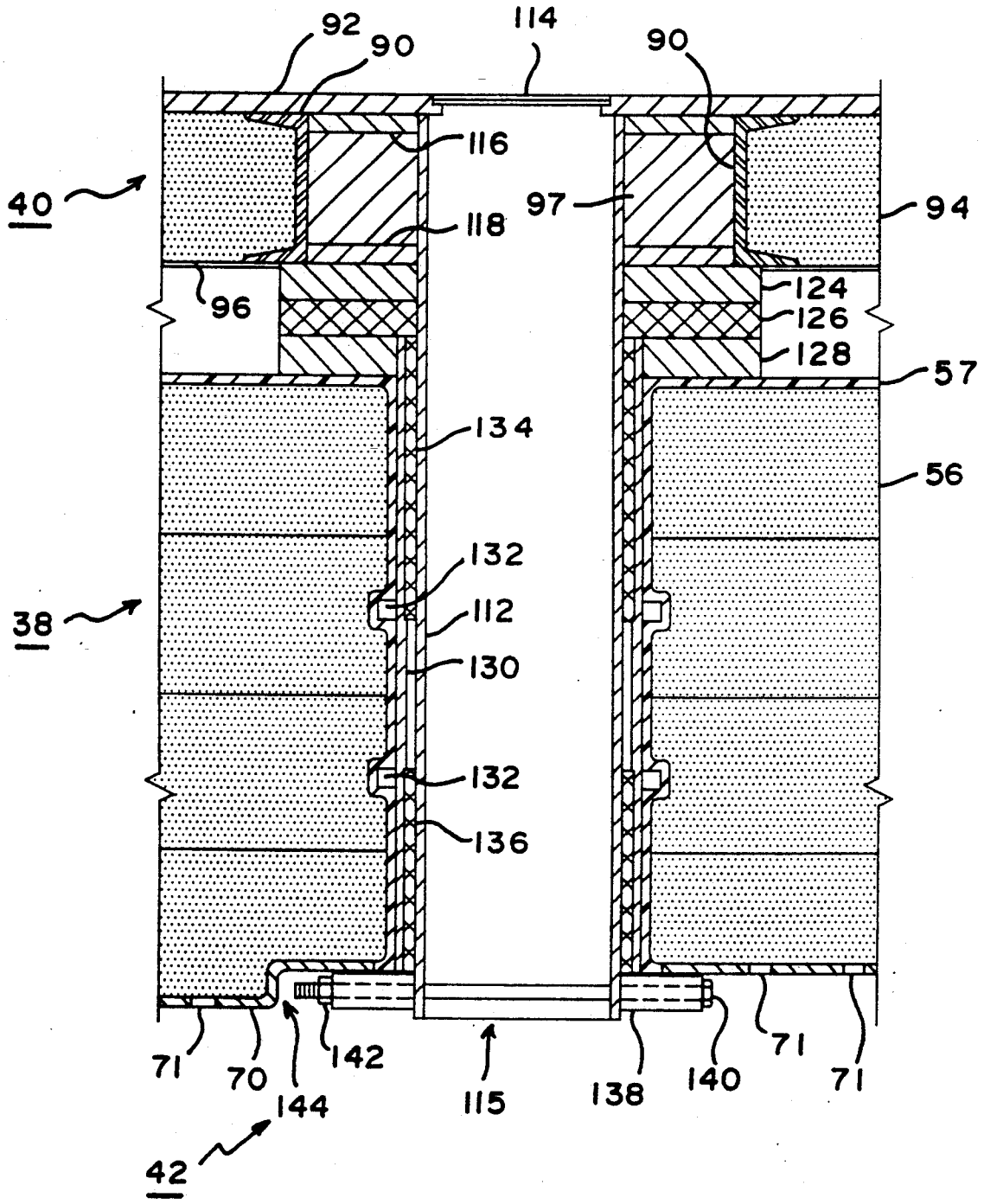
FIG. 6 is an elevational view shown in section of the rotary connector between the passenger platform and the buoyant hull of the raft of FIG. 4.
Figure 12:
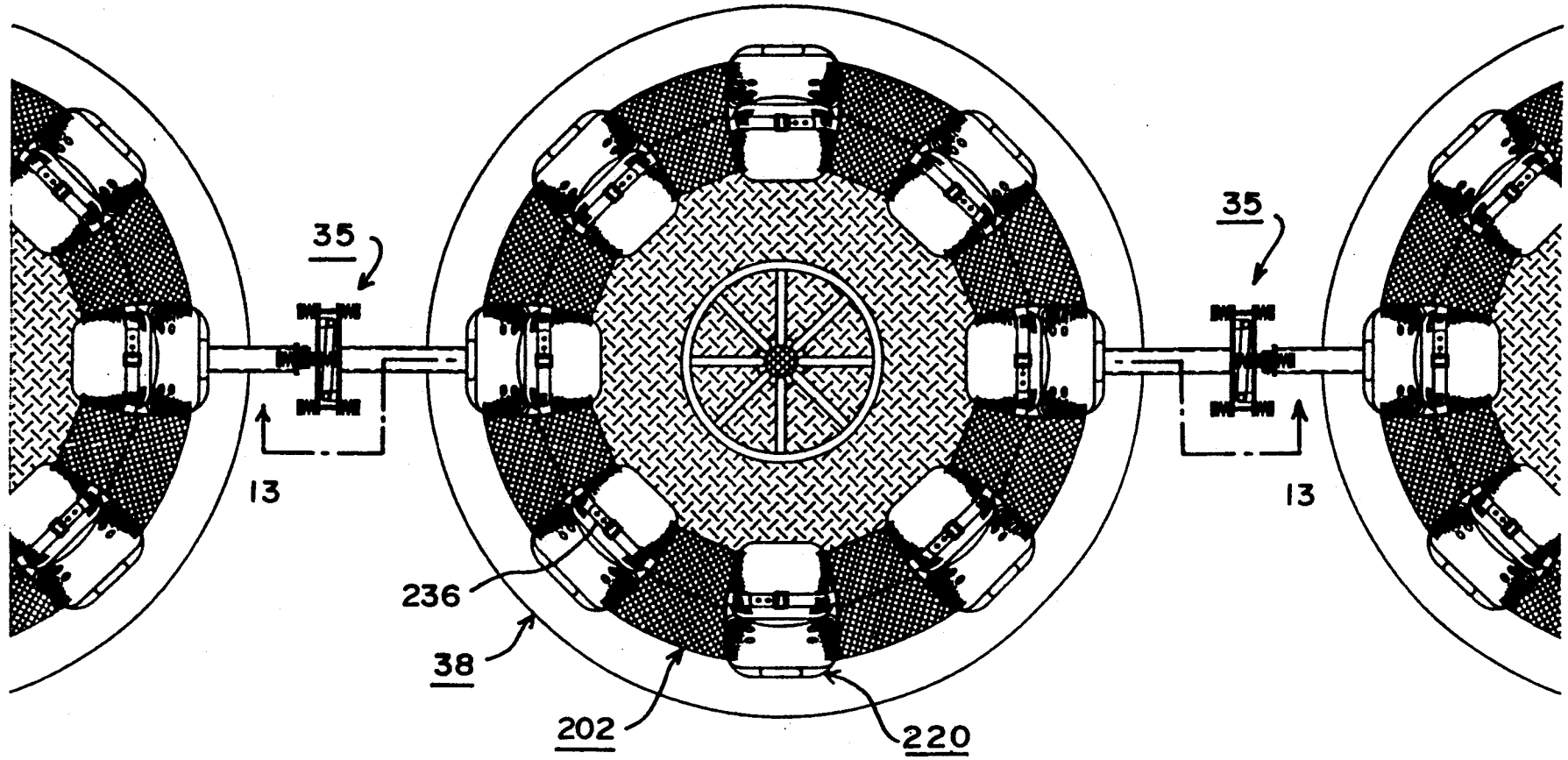
FIG. 12 is a plan view of a raft group showing a modification of the invention wherein a buoyant hull and a passenger platform both rotate.
Figure 13:
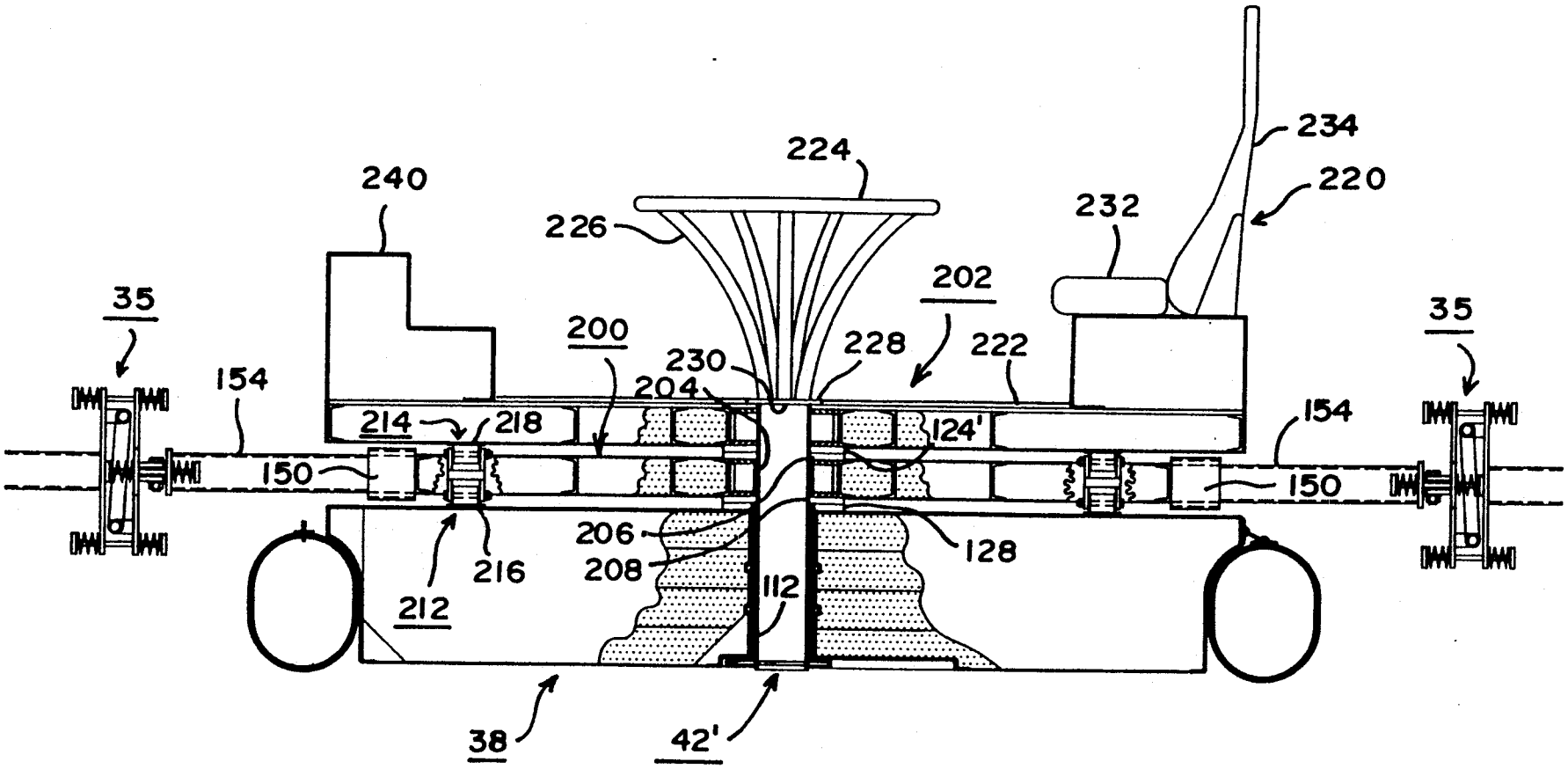
FIG. 13 is a side elevational view in section taken along line 13—13 of FIG. 12.

Referring now to FIGS. 12 and 13, there is shown a modification of the invention wherein adjacent rafts are linked together through a frame 200 which is referred to as an intermediate frame because it is positioned at an intermediate elevation between buoyant hull 38 and a modified passenger platform 202. In this arrangement, the central support shaft 112 of rotary connector 42 is also journalled for rotation relative to frame 200 so that buoyant hull 38 and passenger platform 202 are both free to rotate relative to intermediate frame 200, as well as being free to rotate relative to each other. Thus, while support shaft 112 is fixed to platform 202 in the same manner that it is fixed to platform 40 as shown in FIG. 6, support shaft 112 is free to rotate relative to both frame 200 and buoyant hull 38. Thus, rotary connector 42, is essentially the same as rotary connector 42 except that free floating thrust washer 126 has been replaced by frame 200. Frame 200 has a central aperture 204 for passage of support shaft 112, and aperture 204 is surrounded by an upper bearing plate 206 for engaging upper thrust plate 124, fixed to platform 202, and a lower bearing plate 208 for engaging lower thrust plate 128 fixed to hull 38 (FIG. 6). Bearing plates 206 and 208 are fixed to intersecting channel members of frame 200 by upper and lower mounting plates, respectively, and upper thrust plate 124, is fixed to intersecting channel members of platform 202 by a lower mounting plate, in substantially the same manner as thrust plate 124 is connected to channel members 90 and 120 of platform 40 (FIG. 6).

Additional support for rotation of hull 38 relative to frame 200 is provided by a first set of rollers 212, and additional support for rotation of platform 202 relative to frame 200 is provided by a second set of rollers 214. Both sets of rollers are mounted on frame 200 in substantially the same manner as the set of rollers 79 is mounted on platform 40 (FIG. 4), the rollers of set 212 being equally spaced around the lower periphery of frame 200 for travel along an annular race 216 fixed to the upper surface of hull 38, and the rollers of set 214 being equally spaced around the upper periphery of frame 200 for travel along an annular race 218 fixed to the lower surface of platform 202.

As may be seen in FIG. 13, the mounting sleeve 150 of linkage assembly 35 rotatably connects drawbar 154 to frame 200, instead of two passenger platform 202. Another difference between the embodiment of FIGS. 1-4 and the embodiment of FIGS. 12-13 is the seating arrangement for passengers. As seen best in FIG. 12, platform 202 is circular and eight (8) seats are evenly spaced around the perimeter thereof There may of course be any suitable smaller or larger number of seats, up to 20 or more. In the area in front of these seats is a circular deck plate 222, and a hand rail 224 supported by a plurality of stanchions 226 secured to platform 202 at a ring 228 around a drain 230. Each seat 220 includes a seat cushion 232, a backrest 234 and a seat belt 236. Also evenly spaced around the perimeter of platform 202 and interspersed between the seats are eight (8) stepped platforms 240 which serve as steps for entering and exiting the central occupancy area of the passenger platform There may be a larger or smaller number of stepped platforms, depending on the number of seats and whether some of the seats are grouped so that some do and some do not have stepped platforms between them.

It is also feasible to have platform 202 and hull 38 fixed to each other so as to rotate together. By way of example, support sleeve 130 of connector 42, would be eliminated and anchoring disks 132, 132 embedded in fiberglass shell 57 of the hull would be connected directly to support shaft 112 thereby fixing the support shaft to the hull. Along the same lines, a foreshortened support sleeve having at least one bushing would be secured between bearing plates 206 and 208 to provide a journal for supporting shaft 112 for rotation on frame 200.

Figure 14:
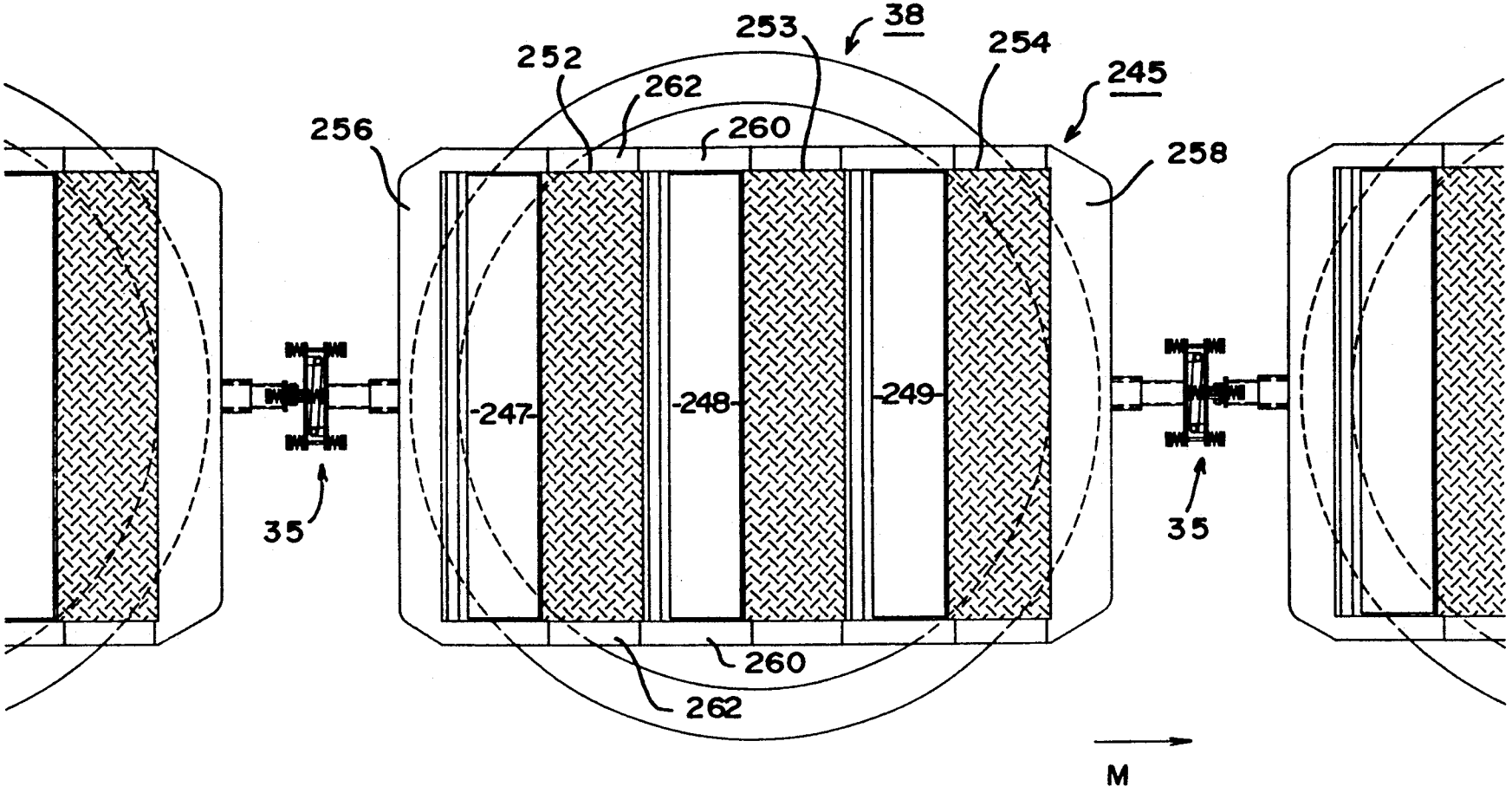
FIG. 14 is a plan view of a raft group showing a modification of the platform and seating arrangement for passengers.
Figure 15:
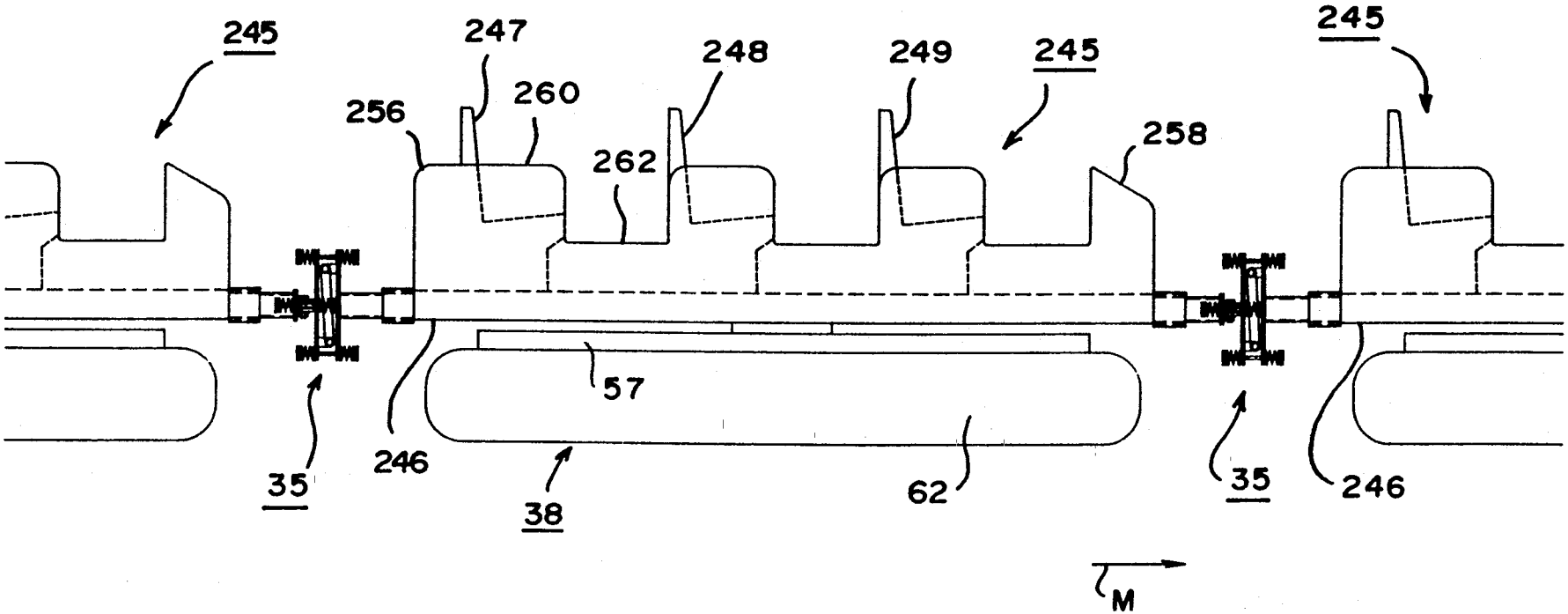
FIG. 15 is a side elevational view of the raft group of FIG. 14.

FIGS. 14 and 15 show an alternative arrangement for the seats mounted upon the platform. In this embodiment, the passenger platform 245 is rectangular and a plurality of parallel seats 247, 248 and 249 are arranged one behind the other and face in the direction of movement M of the raft group. In front of the seats are corresponding individual deck plates 252, 253 and 254, respectively. Behind the rear seat 247 is a rear end panel 256 and a front panel 258 provides a footrest in front of front seat 249. Each seat includes a pair of arm rests 260, 260 and a pair of steps 262, 262 are provided for entering an exiting the passenger areas defined by deck plates 252, 253 and 254.

Figure 16:
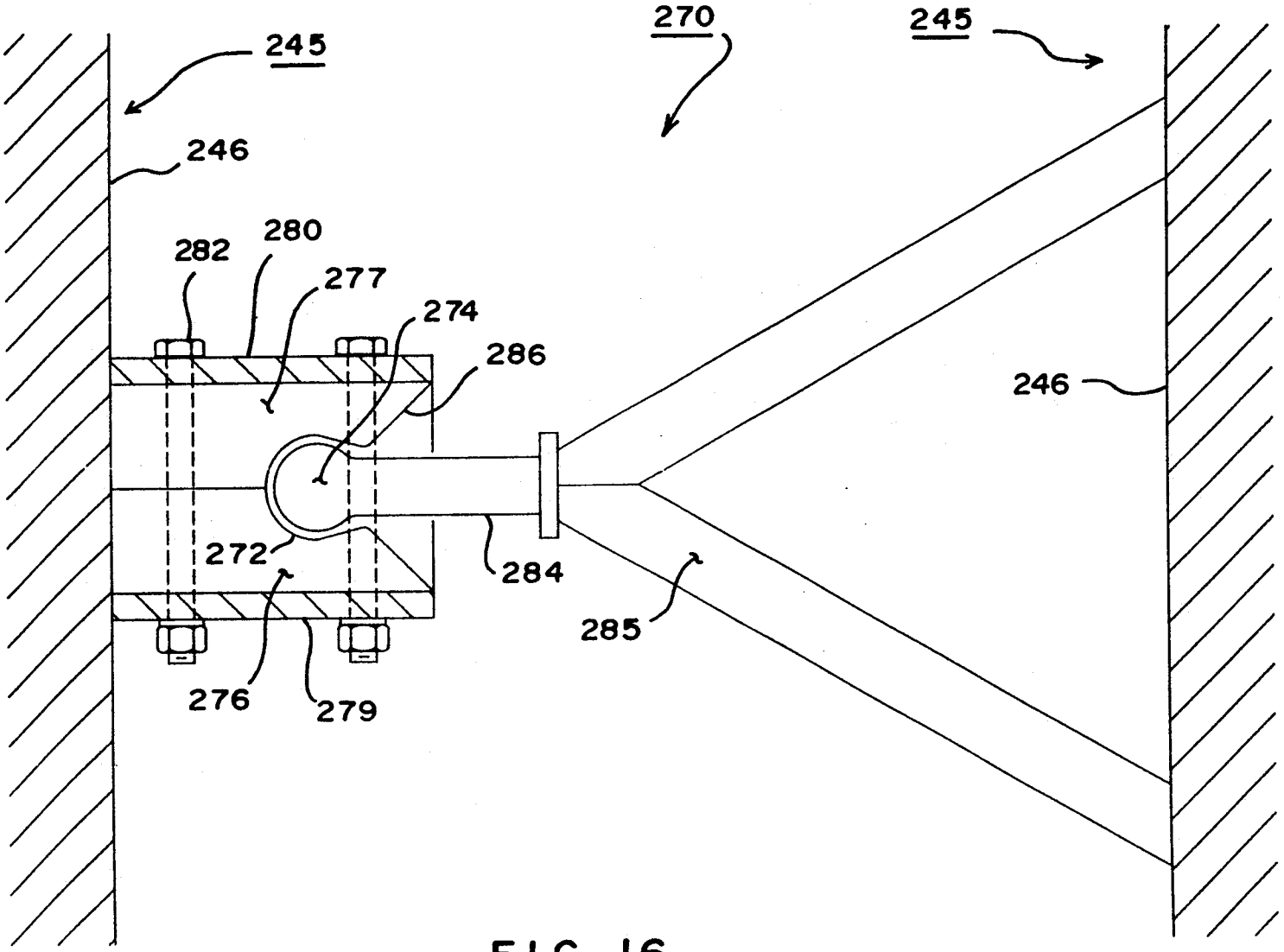
FIG. 16 is a plan view showing a modification of the linkage assembly for interconnecting two adjacent rafts of the raft group of FIGS. 14 and 15; and, FIG. 17 is a side elevational view of the linkage assembly of FIG. 16.
Figure 17:
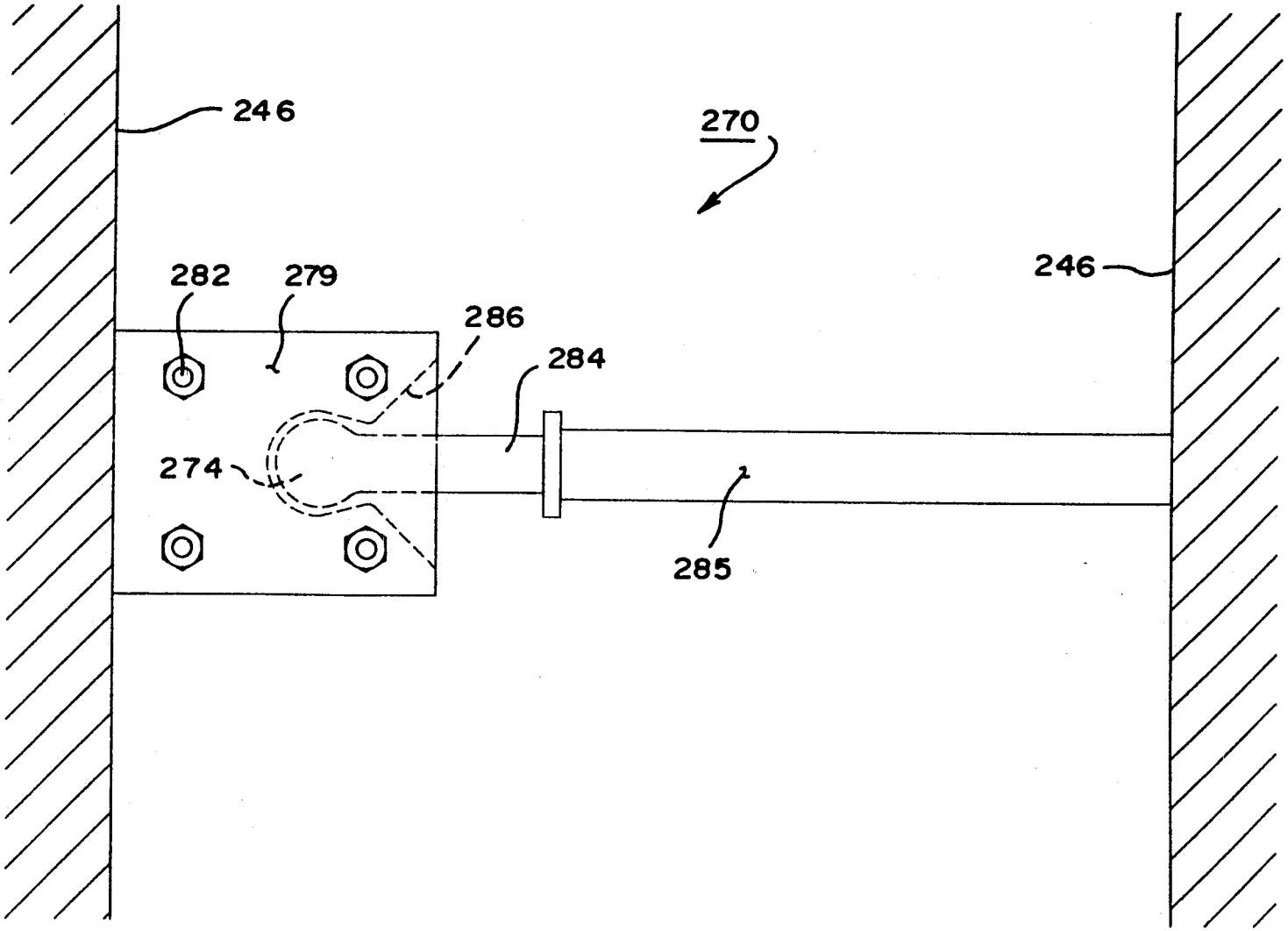

As indicated in FIGS. 14 and 15, a plurality of rafts 245, 245, 245 may be tethered together by linkage assembly 35 as previously described with reference to FIGS. 7-10. However, linkage assemblies which provide a more restricted range of relative movement between the interconnected rafts may be used in many applications, such as where the rafts are touring vehicles along a calm and relatively level waterway with relatively gentle curves. For such applications, the linkage assembly may be of the ball and socket type, such as the linkage assembly 270 shown in FIGS. 16 and 17.

Linkage assembly 270 provides a socket 272 for receiving a ball 274. Socket 272 is formed by two half pieces 276 and 277 of wear resistant material clamped between two opposing plates 279 and 280 held together by four bolts 282. Mounting plates 279 and 280 are fixed to an end of the platform 246 of one of the rafts 245 by welding or the like. Ball 274 is mounted on the distal end of a drawbar 284, and the proximate end of drawbar 284 is connected to an adjacent raft 245 by a frame 285, preferably made of steel tubing. Ball 274 is mounted on the distal end of a drawbar 284, and the surrounding ends of pieces 276 and 277 are shaped to provide a conical surface 286 which allows drawbar 284 a sufficient amount of pivotal movement around the yaw and pitch axes and combinations thereof to permit relative movement between the interconnected rafts 245, 245 in yaw and pitch. Linkage assembly 270 is preferably able to provide pitch and yaw angles between the adjacent linked rafts of at least about 5°, more preferably at least about 10°, still more preferably at least about 20° and most preferably about 30° or more.

What is claimed is:

1. A raft for an amusement ride, said raft having:

A. at least one passenger support having accommodations thereon sufficient to accommodate at least one passenger, B. at least a first link positioned on said raft, said first link being matingly compatible with a second link on another raft of said ride, C. at least one buoyant member and D. at least one connection between the buoyant member(s) and at least one connected portion of said raft, 1. said connected portion being at least one portion of said raft other than said buoyant member(s) and being connected with said buoyant member(s) through said connection(s), and 2. said connection(s) comprising at least one rotary connector which provides rotation of the buoyant member(s) about a generally upright axis, including rotation relative to said connected portion(s) and relative to said first link.

2. Apparatus according to claim 1 wherein said at least one connection is an indirect connection between said at least one buoyant member and said at least one connected portion.

3. Apparatus according to claim 1 wherein said at least one connected portion is said at least one passenger support, and said passenger support(s) and said at least one buoyant member are connected to one another through said at least one rotary connector to provide rotation of the buoyant member(s) relative to the passenger support(s).

4. Apparatus according to claim 1 wherein said raft includes a frame in addition to said at least one passenger support, said at least one connected portion is said frame, and said frame and said at least one buoyant member are connected to one another through said at least one rotary connector to provide rotation of the buoyant member(s) relative to the frame.

5. Apparatus according to claim 4 wherein said at least one passenger support is fixed secured to said frame.

6. Apparatus according to claim 1 wherein said at least one passenger support of said raft has an outline in plan view which is non-circular.

7. Apparatus according to claim 1 wherein said at least one passenger support of said raft has seats disposed thereon in one or more arrays that, as viewed in plan view, are non-circular.

8. An amusement ride comprising a plurality of rafts including at least two rafts each having at least one passenger support and at least one buoyant member, said ride having:

A. a channel having fabricated guide members therein which are configured for guiding said rafts in a flow of water along a flow path in said channel;

B. said ride further comprising:

1. at least a first link that a. extends between and links said at least two rafts for retaining them generally adjacent one another, and b. provides the linked rafts with freedom of motion relative to one another, at said first link, in at least one direction; and 2. connections, including at least one connection in each of said two rafts, between at least one respective buoyant member and at least one respective connected portion in each of said two rafts, a. each respective connected portion being a portion of one of said two rafts that is other than a buoyant member thereof and being connected with the respective buoyant member of said raft through one of said connections, and b. said connections respectively comprising rotary connectors which provide rotation of the respective buoyant members relative to the respective connected portions.

9. Apparatus according to claim 8 wherein said connections are indirect connections between the respective buoyant members and the respective connected portions.

10. Apparatus according to claim 8 wherein the respective connected portions are passenger supports, and said passenger supports are connected with the respective buoyant members through the respective rotary connectors to provide rotation of the buoyant members relative to the passenger supports.

11. Apparatus according to claim 8 wherein said at least two rafts respectively include passenger supports and frames, the respective connected portions are said frames, and said frames are connected with the respective buoyant members through the respective rotary connectors to provide rotation of the respective buoyant members relative to the

12. Apparatus according to claim 11 wherein said passenger supports are fixedly secured to said frames.

13. Apparatus according to claim 8 wherein each of said at least two rafts has a passenger support with an outline in plan view which is non-circular.

14. Apparatus according to claim 8 wherein each of said at least two rafts has a passenger support with an elongated outline in plan view and wherein said at least two rafts are maintained in said channel with their elongations disposed generally in the direction of said flow path.

15. Apparatus according to claim 8 wherein each of said at least two rafts has a passenger support and, as viewed in plan view, has seats disposed therein in one or more non-circular arrays.

16. Apparatus according to claim 8 wherein each of said at least two rafts has a passenger support and, as viewed in plan view, has seats disposed thereon in one or more arrays extending generally in

17. Apparatus according to claim 8 wherein said at least two rafts respectively have passenger supports and the respective rotary connectors provide relative rotation of the respective buoyant members and passenger supports about a generally upright axis.

18. Apparatus according to claim 8 wherein the respective rotary connectors provide rotation of the respective buoyant members relative to said first link.

19. Apparatus according to claim 8 wherein said at least two rafts are joined in series relationship with one another along said flow path.

20. Apparatus according to claim 8 wherein said first link is a resilient member.

21. Apparatus according to claim 8 wherein said first link includes a member, extending between adjacent rafts joined by said link, which is resistant to longitudinal compression and extension exerted thereon by movement of said rafts toward and away from one another.

22. Apparatus according to claim 8 wherein said first link is a universal connector.

23. Apparatus according to claim 8 wherein said linked rafts have horizontal axes which pass through said first link and across the centers of their respective rotary connectors, and said linked rafts have freedom of motion relative to one another through said link in at least one direction which is not parallel to and does not coincide with said axes.

24. Apparatus according to claim 8 wherein said freedom of motion includes motion about at least one axis selected from among pitch, yaw, roll and combinations thereof.

25. Apparatus according to claim 8 wherein said freedom of motion includes motion about the yaw axis, or motion about at least one other axis selected from among pitch and roll, or a combination of the foregoing.

26. Apparatus according to claim 8 wherein each of said at least two rafts is at least partly afloat in the water in the channel.

27. Apparatus according to claim 8 wherein said guide members are distributed along the flow path in position to contact portions of the respective buoyant members but not said passenger supports as said at least two rafts move along said flow path.

28. Apparatus according to claim 8 wherein the channel includes guide members distributed along the flow path in position to contact the respective buoyant members of each of said at least two rafts and to rotate said buoyant members relative to the passenger supports to which they are connected.

29. Apparatus according to claim 8 wherein the channel includes guide members distributed along the flow path and positioned to cause undulating motion of said rafts including pitch, yaw, roll or any combination thereof.

30. Apparatus according to claim 8 wherein said guide members are portions of one or more walls of said channel.

31. An amusement ride comprising at least on raft having at least one passenger support and buoyant means, said ride including:

A. a channel configured for conducting a flow of water through said channel,

B. fabricated guide members included in said channel for guiding said raft in said flow of water along a flow path in said channel, C. engaging means defined by an external surface of said buoyant means, D. said guide members being so positioned to cause frictional engagement of said engaging means with said guide members as said raft is guided in said flow of water along said flow path, E. said raft further including:

1. a frame to which said passenger support is secured; and 2. a rotary connector for mounting at least part of said buoyant means for rotation relative to said frame and for causing said buoyant means part, including said engaging means, to rotate relative to said frame upon such frictional engagement of said engaging means with said guide members.

32. An amusement ride according to claim 31 wherein said frame and passenger support are arranged in an assembly in which they are in fixed relationship with one another, and said rotary connector connects said buoyant means with said frame for rotation of said buoyant means relative to said assembly.

33. An amusement ride according to claim 31 wherein said frame and passenger support are arranged in an assembly with securing means for securing said passenger support to said frame and wherein said securing means provides rotation of said passenger support relative to said frame.

34. An amusement ride according to claim 31 further comprising means operable for causing said passenger support to rotate relative to said frame.

35. An amusement ride according to claim 31 wherein said rotary connector comprises means for providing rotation of said buoyant means relative to said passenger support means.

36. An amusement ride according to claim 31 wherein said buoyant means comprises annular wall means defining at least one peripheral air chamber, and wherein said rotary connector comprises means for providing rotation of said annular wall means relative to said frame.

37. An amusement ride according to claim 36 wherein said engaging means is positioned along an outer periphery of said buoyant means, at least a portion of said outer periphery of said annular wall means defines an outer surface of said raft, and said engaging means comprises an elastomeric material at said outer surface for frictionally engaging said guide members.

38. An amusement ride according to claim 31 further comprising a first one of said raft means, a second one of said raft means, and link means for connecting together the frame of said first raft means and the frame of said second raft means so that said first and second raft means travel together along said channel, said link means providing for movement of said first and second raft means relative to each other in at least one axis selected from among yaw, pitch and roll.

39. An amusement ride according to claim 38 further comprising a channel having upstanding guide members in sufficiently closely spaced relation to one another, and extending along a substantial portion of the length of the channel, to prevent one of said raft means from passing the other of said raft means while said two raft means are travelling together along said channel.

40. An amusement ride according to claim 38 wherein said link means comprises pivot means for providing pivotal movements of said first and second raft means relative to each other in yaw, pitch and roll.

41. An amusement ride according to claim 40 wherein said pivot means comprises at least one universal joint.

42. An amusement ride according to claim 40 wherein said link means further comprises pivot limit means for limiting the range of at least one of said pivotal movements.

43. An amusement ride according to claim 38 wherein said link means comprises elongated bar means, said elongated bar means comprises a first member, a second member mounted for extensible movement relative to said first member, and shock absorbing means for dampening the extensible movement of said second member relative to said first member.

44. An amusement ride according to claim 31 wherein said frame has a substantially circular periphery, and wherein said passenger support means comprises a plurality of seats for occupancy by a corresponding number of passengers, said seats facing radially inward.

45. An amusement ride according to claim 31 wherein said frame has a substantially rectangular periphery, and wherein said passenger support means comprises a plurality of seats for occupancy by a corresponding number of passengers, said seats facing in substantially the same direction and being arranged in at least one row.

46. An amusement ride according to claim 45 wherein said plurality of seats are arranged in a plurality of rows.

47. An amusement ride according to claim 31 wherein said buoyant means comprises a plurality of rotatable parts, wherein said rotary connector includes means for mounting each of said rotatable parts for rotation relative to said frame, and wherein each of said rotatable parts comprises engaging means for engaging said guide members to cause the corresponding rotatable part to rotate relative to said frame.

48. An amusement ride according to claim 31 wherein the rotatably mounted part of said buoyant means has an outer periphery which defines a substantially continuous closed curve.

* * * * *